US006134814A

United States Patent [19]

Christy et al.

[11] Patent Number: 6,134,814

[45] Date of Patent: Oct. 24, 2000

[54] HYDRAULIC LOCKING CYLINDER FOR PLOW BLADES

[75] Inventors: Jody Christy, Iron Mountain, Mich.; Gale Thelean, Orchard Park, N.Y.

[73] Assignee: M. J. Electric, Inc., Iron Mountain, Mich.

[21] Appl. No.: 09/320,672

[22] Filed: May 27, 1999

Related U.S. Application Data

[60] Provisional application No. 60/087,069, May 28, 1998.

[51] Int. Cl.[7] ..... E01H 5/04

[52] U.S. Cl. ..... 37/236; 37/273

[58] Field of Search ..... 37/217, 236, 235, 37/266, 269, 272, 273, 283; 172/816, 818, 819, 820, 821, 272; 414/726, 686

[56] References Cited

U.S. PATENT DOCUMENTS 4,658,519 4/1987 Quenzi ..... 37/273

*Primary Examiner*—Robert E. Pezzuto
*Attorney, Agent, or Firm*—Jim Zegeer

[57] ABSTRACT

A plow having a frame attached to a vehicle and a pair of hinged plow blades pivotally mounted on the frame, a first single acting hydraulic actuator extending between the frame and a first one of the plow blades, a second single acting hydraulic actuator extending between the frame and a second of the plow blades, a first tension spring extending between the first one of the plow blades and the frame, a second extension spring extending between the second plow blade and the frame. Each of the single acting cylinders includes a piston on a cylinder, characterized by each single acting hydraulic actuator includes hydraulic valve elements for locking the blades in position to prevent loss of material mass behind the blades when the plow is being used to back blade. In one embodiment, the single acting hydraulic actuators include a counterbalance valve located in the position of the cylinder to provide hydraulic locking and overload protection. In a second embodiment the single acting hydraulic actuators include a pilot operated check valve in the piston to provide hydraulic locking.

3 Claims, 3 Drawing Sheets

HYDRAULIC LOCKING CYLINDER FOR PLOW BLADES

REFERENCE TO RELATED APPLICATION

This invention is the subject of provisional application Ser. No. 60/087,069 filed May 28, 1998 and entitled HYDRAULIC LOCKING CYLINDER.

BACKGROUND AND BRIEF DESCRIPTION OF THE INVENTION

The current plows use single acting hydraulic cylinders to move the blade half from the retracted position to the extended position. The single acting cylinder can only produce force to extend the wing. An extension spring provides opposing force to the hydraulic cylinder to retract the blade.

Since the hydraulic cylinder is single acting, the extension spring is the only means of force preventing the blade half from extending. It is possible to pull the cylinder rod out of the cylinder tube creating a vacuum in the cylinder.

When the plow is being used to back blade (as when pulling snow away from a garage door), only the force from the extension spring resists the snow load and frictional force acting to extend the wings. When the snow load and frictional force exceeds the resistive force of the extension spring, the blades extend forward resulting in loss of the snow mass behind the blade.

An hydraulic means of locking the blade half in place will prevent loss of the snow mass behind the blade.

Double acting cylinders provide an hydraulic means of locking the blade half in place. However, a complicated hydraulic circuit is required. Further, the power unit must produce pressure both to extend and retract the blade half.

The object of the invention is to provide a hydraulic locking cylinder for plow blades to enable back blade plowing.

Locking cylinder embodiments have been developed which will hydraulically lock the blade half in place without the complexity of required in the dual acting cylinder hydraulic circuit. One embodiment uses a counter balance 9 valve located in the piston of the cylinder, and another embodiment uses a pilot operated check valve also in the piston Using a counter balance valve provides a relief function so that when an obstacle is hit during back blading, the cylinder may pass fluid over the relief valve to protect the blade from the impact force. The pilot operated check valve design does not provide a relief function during back blading. By using the locking cylinder design, the complexity of the circuit is reduced and pressure from the power unit is only required when extending the wing. The locking cylinders are interchangeable with existing single-acting cylinders with no additional hydraulics required.

DESCRIPTION OF THE DRAWINGS

The above and other objects, advantages and features of the invention will become more clear when considered with the following specification and accompanying drawings wherein.

DETAILED DESCRIPTION OF THE INVENTION

Reference is made to Capra et al, U.S. Pat. No. 5,568,694 (incorporated herein by reference) for a full exposition of the plow and its operation.

Figure 1:
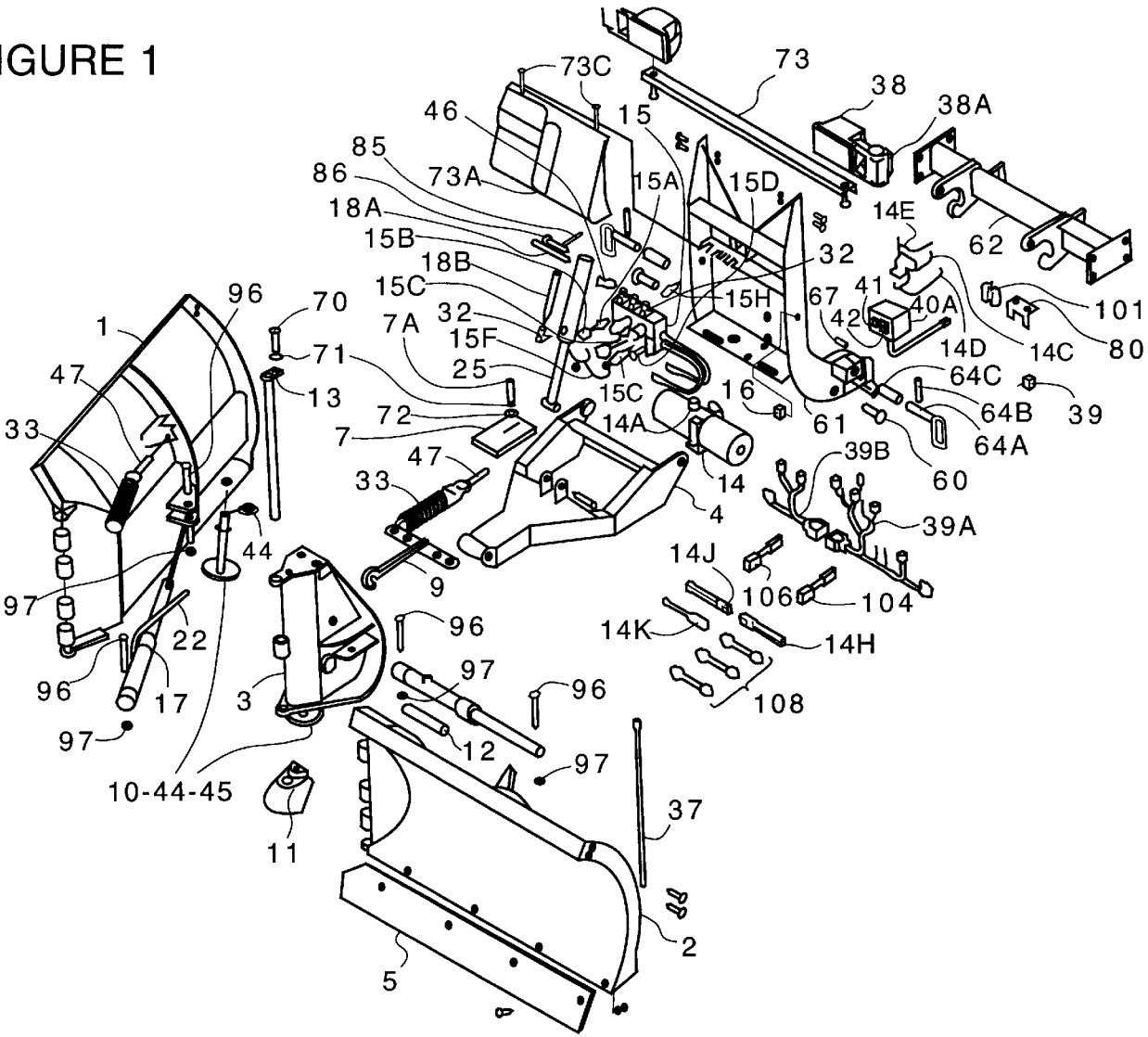
FIG. 1 is an exploded view of a snow plow system incorporating the invention.

Referring to the exploded view of a plow shown in FIG. 1, the following list sets out the component part number and description of the component part:

| Component Part | Description |
|---|---|
| 1 | Blade Half Right |
| 2 | Blade Half Left |
| 3 | Center Section, RT3 V-Blade (all models) |
| 4 | T-Frame, RT3 V-Blade (all models) |
| 5 | Cutting Edge, 7'6" V-Blade 5/8" Holes |
| 5 | Cutting Edge, 8'2" V-Blade 5/8" Holes |
| 5 | Cutting Edge, 9'2" V-Blade 5/8" Holes |
| 6 | Carriage Bolt Set |
| | Includes: (10) Carriage Bolts ⅝"-11 × 2" Grade #5 ZN |
| | (10) 5/8" Hardened Washers |
| | (10) 5/8" Lock Nuts |
| 7 | Bumper Stop, w/Mounting Hardware |
| 7 | A Self-Tapping Bolt, ⅜" - 16 × 2" Hex Washer Head ZN |
| 9 | Spring Yoke, RT3 V-Blade |
| 10-44-45 | Plow Shoe Assembly |
| | Includes: (1) Plow Shoe (1" Shaft) |
| | (1) 7/16" Quick Pin |
| | (20) 1" FIat Washers |
| 10-44-45 | Plow Shoe, Cast Iron (Center Shoe) |
| | Includes: (1) Plow Shoe (1" Shaft), Cast Iron |
| | (1) 7/16" Quick Pin |
| | (20) 1" flat Washers |
| 11 | Snow Catcher w/Mounting Hardware |
| 12 | Horizontal Hinge Pin Kit, RT3 V-Blade (all models) |
| 13 | Center Hinge Pin, RT3 V-Blade (all models) |
| 14 | Hydraulic Pump Power Unit - Barnes |
| 14 A | Hydraulic Pump Filler Cap |
| 14 B | Hydraulic Pump Motor - Barnes |
| 14 C | Hydraulic Pump Solenoid |
| 14 D | Hydraulic Pump Solenoid Ground Cable |
| 14 E | Battery cable, 66" |
| 14 H | Ground/Power Cable 60" (Vehicle Side) |
| 14 J | Ground/Power Cable 36" (Plow Side) |
| 14 K | Ground/Power Cable Dust Cap/Plug |
| 14 L | Hydraulic Reservoir Drain Plug |
| 15 | Hydraulic Valve Assembly with SmartHitch |
| 15 A | Hydraulic Lift/Angle Valve |
| 15 B | Hydraulic Valve Coil |
| 15 C | Hydraulic Relief Valve |
| 15 D | Hydraulic Check Valve |
| 15 E | Hydraulic Valve Screen Cartridge |
| 15 F | Hydraulic Valve Ground Strap |
| 15 G | Hydraulic Valve, SmartHitch Attach |
| 15 H | Hydraulic Valve, Flow Control Cartridge |
| 16 | SmartHitch Toggle Switch Kit (Includes Switch and Jumpers) |
| 17 | Hydraulic Cylinder, Angle |
| 18 A | Hydraulic Hose ¼" × 12", ¼" MNPT × ¼" MNPT) |
| 18 B | Hydraulic Hose ¼" × 15-½", (¼" MNPT × ¼" MNPT) |
| 18 C | Hydraulic Hose ¼" × 15" (¼" ORB × ¼" MNPT) |
| 22 | Hydraulic Hose ⅜" × 40" (¼" MNPT × 3/8" MNPT) |
| 25 | Hydraulic Cylinder, RT3 Lift |
| 32 | Hydraulic Swivel Fitting, 90 Deg. (¼" ORS × ¼" FPS) |
| 33 | Trip/Return Spring |
| 37 | Blade Guide Set |
| 37 A | Blade Guide Tip |

-continued

| Component Part | Description |
|---|---|
| 38 | Auxiliary Headlight Set, Low Profile Plastic |
| 38 A | Turn Signal Cover, Low Profile Plastic |
| 38 L | Auxiliary Headlight, Left, Low Profile Plastic |
| 38 R | Auxiliary Headlight, Right, Low Profile Plastic |
| 39 | Auxiliary Light Harness Assembly<br>Includes: Toggle Switch<br>Connectors |
| 39 A | Light and Control Harness 116" (Vehicle Side) |
| 39 B | Light and Control Harness 48" (Plow Side) |
| 40 A | Switch Box Control, V-Blade |
| 40 B | Joystick Control, V-Blade |
| 41 | Rocker Switch - Lift |
| 42 | Rocker Switch - Angle |
| 44 | Quick Pin - 7/16" |
| 46 | Hydraulic Fitting, 90 Deg. (1/8" MNPT × 1/4" FNPT) |
| 47 | Eye Bolt, 1/2" |
| 55 | Hex Head Cap Screw, 5/8" - 11 × 4-1/2" GRS ZN |
| 60 | Pivot Pin, Kit (Includes Cotter Pins and Washers) |
| 60 A | Pivot Pin |
| 60 B | 3/16" Cotter Pin |
| 61 | Coupler Assembly |
| 62 | Push Beam Assembly, RT 3 |
| 62 A | Push Beam Support Plat RH (Passenger Side) |
| 62 B | Push Beam Support Plate LH (Driver Side) |
| 64 | Coupler Spring Pin Kit<br>Includes: Coupler Spring Pin<br>Rolled Pin<br>Coupler Spring Pin Spring |
| 64 A | Coupler Spring Pin |
| 64 B | Rolled Pin (5/16" × 20-1/2") |
| 64 C | Coupler Spring Pin Spring |
| 67 | Spring, SmartHitch Torsion Spring |
| 71 | Washer, 3/8" Split Lock |
| 72 | Washer, 3/8" Fender |
| 73 | Light Bracket Assembly |
| 73 A | Hydraulic Enclosure Cover |
| 73 B | Rubber Grommet |
| 73 C | Thumb Screw, 10–24 × 1/2" |
| 75 A | Angle Bracket RH (Passenger Side) |
| 75 B | Angle Bracket LH (Driver Side) |
| 80 | Control Harness Mounting Bracket |
| 85 | Hairpin Cotter, #16 |
| 86 | Clevis Pin, 5/8" × 3-1/2" |
| 96 | Hex Head Cap Screw, 5/8" - 11 × 5-1/2" GRS ZN |
| 97 | Nut, Self-Locking 5/8" - 11 ZN |
| 101 | Power Ground Cable Mounting Bracket |
| 102 | Rubber Split Grommet, 1-1/8" |
| 104 | Weather Cap for Light & Control Harness (Vehicle Side) |
| 106 | Weather Cap for Light & Control Harness (Plow Side) |
| 108 | Headlight Adapter Kit |

Figure 2:
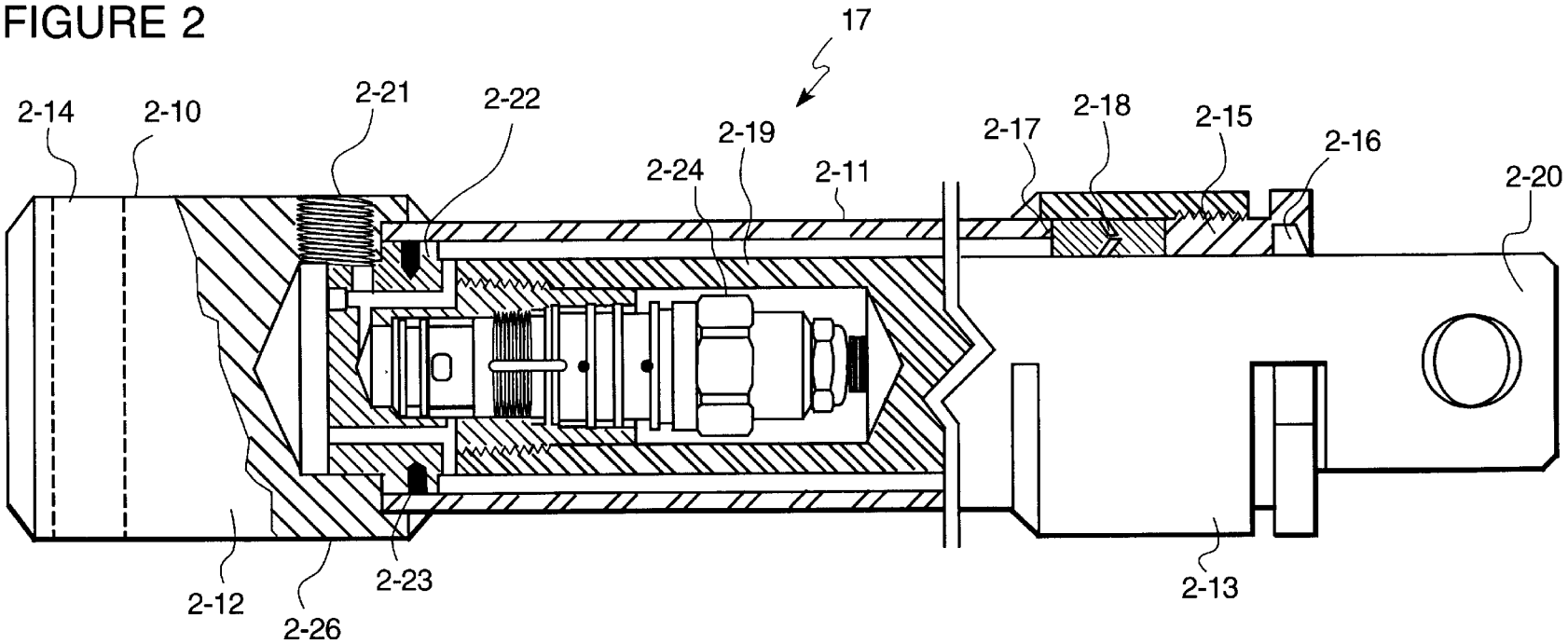
FIG. 2 is a partial sectional view of a hydraulic locking cylinder incorporating the invention.

The present invention relates to the construction and operation of the angle adjust hydraulic cylinder 17. A preferred embodiment of the hydraulic cylinder 17 is shown in FIG. 2 wherein a body assembly 2-10 includes a tubular member 2-11 secured to end fitments 2-12, 2-13. A transverse pivot mounting bore 2-14 is in the end fitment 2-12. Packing nut 2-15 is threadably engaged with end member 2-13 and carries wiper seal 2-16 and, in conjunction with seat ring 2-17 compresses Vee packing set 2-18 in conventional fashion so that piston rod 2-15 telescopes in sealing relation in cylinder 17. A mounting hole 2-20 is formed in the end of piston rod 2-19. A hydraulic fluid port 2-21 is formed in end fitment 2-12 and is connected to the hydraulic fluid supply. A feature of the invention is that it can replace conventional single acting hydraulic cylinders essentially without change to achieve the significant advantages of being able to back blade. A piston 2-22 having seat 2-23 is carried by piston rod 2-19. When pressurized hydraulic fluid is applied to cylinder 17, the piston 12-22 and rod 2-19 move to the right (as indicated by the arrow in FIG. 3A) and the plow blades. 1, 2 are extended and return springs 33 are tensioned or stretched. When the fluid pressure is relieved, the piston 2-22 and piston rod 2-19 retract under the force of return spring 33.

Figure 4:
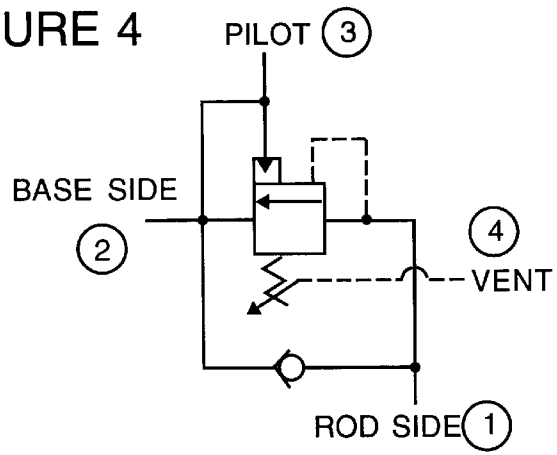
FIG. 4 is a hydraulic schematic circuit diagram of a pilot valve embodiment.
Figure 3C:
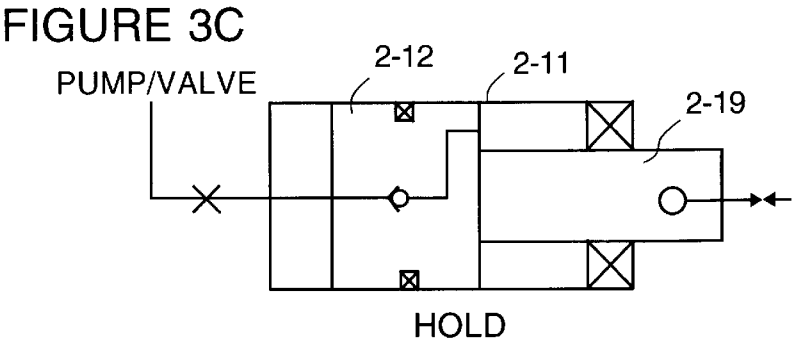
FIGS. 3A–3D are hydraulic schematic circuit diagrams of the load holding hydraulic locking cylinder shown in FIG. 2 (exemplary pressures and forces indicated)
Figure 3D:
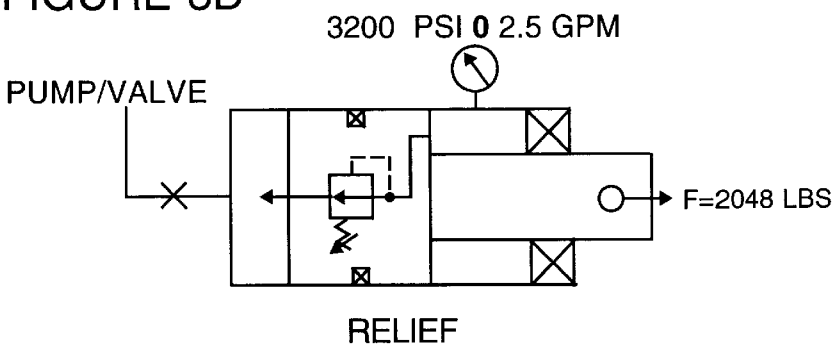
Figure 3A:
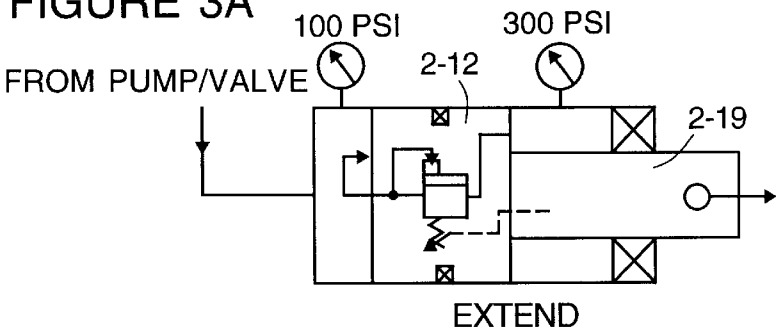
Figure 3B:
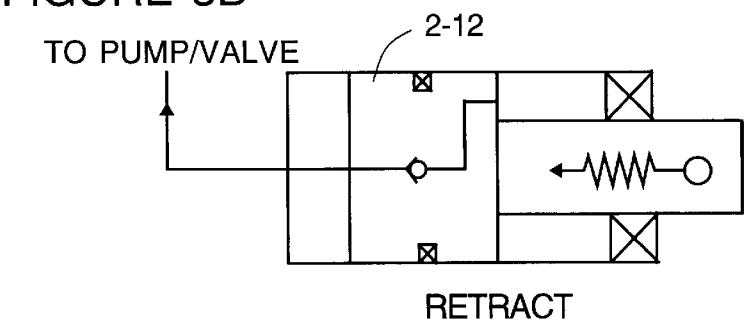

In order to be able to back blade, a counter balance valve or, alternatively, a pilot operated check valve is mounted in the piston. In FIG. 2, a counterbalance valve 2-24 is mounted in the piston 2-22 and rod 2-19. Passages 2-26 in piston 2-22 couple to counterbalance valve 2-24 and includes a check valve (FIGS. 3B, 3C) which provides a relief flow so that when an obstacle is hit during back blading, the cylinder passes fluid over a relief valve to protect the blade from impact force. FIG. 3C illustrates the hold condition with hydraulic fluid (oil) trapped by the check valve, and FIG. 3D illustrates relief flow when the check valve spring in the counterbalance valve has been operated. FIG. 4 is a schematic diagram of a pilot operated check valve mounted in piston 2-22.

Thus, there has been provided a hydraulic locking cylinder for controlling plow blade angles which provide for back plowing without the expense and complexity of a double-acting hydraulic cylinder and which is interchangeable with existing single-acting cylinders with no additional hydraulics required.

While the invention has been described in relation to preferred embodiments of the invention, it will be appreciated that other embodiments, adaptations and modifications of the invention will be apparent to those skilled in the art.

What is claimed is:

1. In a plow having a frame attached to a vehicle and a pair of hinged plow blades pivotally mounted on said frame, a first single acting hydraulic actuator extending between said frame and a first one of said plow blades, a second single acting hydraulic actuator extending between said frame and a second of said plow blades, a first tension spring extending between said first one of said plow blades and said frame, a second extension spring extending between said second plow blade and said frame, each said single acting hydraulic actuator including a piston in a cylinder, the improvement wherein:

each said single acting hydraulic actuator includes hydraulic valve elements mounted in said piston for locking said blades in position to prevent loss of material mass behind said blades when the plow is being used to back blade.

2. The plow defined in claim 1 wherein said hydraulic valve elements include a counterbalance valve located in said piston to provide hydraulic locking and overload protection.

3. The plow defined in claim 1 wherein said hydraulic valve elements actuators include a pilot operated check valve in said piston to provide hydraulic locking.

* * * * *